US010975822B2

(12) United States Patent
Schuele

(10) Patent No.: US 10,975,822 B2
(45) Date of Patent: Apr. 13, 2021

(54) NOZZLE HEAD AND FLUID INJECTION VALVE

(71) Applicant: Continental Automotive GmbH, Hannover (DE)

(72) Inventor: Harry Schuele, Neunburg V. Wald (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 361 days.

(21) Appl. No.: 15/104,002

(22) PCT Filed: Dec. 8, 2014

(86) PCT No.: PCT/EP2014/076912
§ 371 (c)(1),
(2) Date: Jun. 13, 2016

(87) PCT Pub. No.: WO2015/086536
PCT Pub. Date: Jun. 18, 2015

(65) Prior Publication Data

US 2016/0319793 A1 Nov. 3, 2016

(30) Foreign Application Priority Data

Dec. 13, 2013 (DE) ..... 10 2013 225 948.4

(51) Int. Cl.
*F02M 61/18* (2006.01)
*F02M 61/04* (2006.01)

(52) U.S. Cl.
CPC ..... *F02M 61/1853* (2013.01); *F02M 61/04* (2013.01); *F02M 2200/06* (2013.01)

(58) Field of Classification Search
CPC ..... F02M 61/1853; F02M 61/04; F02M 61/1806; F02M 61/1833; F02M 61/1846; B05B 1/185; B05B 1/18
(Continued)

(56) References Cited

U.S. PATENT DOCUMENTS 1,444,263 A * 2/1923 Mustee ..... F23D 14/04 239/424
4,531,678 A 7/1985 Knapp ..... 239/533.3
(Continued)

FOREIGN PATENT DOCUMENTS

DE 3230671 A1 2/1984 ..... F02M 51/06
DE 3801778 A1 7/1989 ..... F02M 51/06
(Continued)

OTHER PUBLICATIONS

German Office Action, Application No. 102013225948.4, 11 pages, dated Oct. 31, 2014.
(Continued)

*Primary Examiner* — Tuongminh N Pham
(74) *Attorney, Agent, or Firm* — Slayden Grubert Beard PLLC

(57) ABSTRACT

The invention relates to a nozzle head and to a fluid injection valve, in particular to a motor vehicle injection valve. A nozzle head for atomizing a fluid for a fluid injection valve with a valve body, through which flow can pass, may include a longitudinal axis and a nozzle perforated disk having a front surface and an opposite inner surface. The nozzle perforated disk may comprise at least one nozzle hole channel completely penetrating the nozzle perforated disk in the direction of the longitudinal axis and including includes an entry surface at a first channel end and an outlet surface at a second channel end wherein the entry surface is formed on the inner surface of the nozzle perforated disk. A nozzle hole projection of the nozzle hole channel has a channel wall with a wall height (h) extending away from the inner surface and is configured over a circumference of the nozzle hole projection so that the second channel end corresponds to a channel wall end of the channel wall configured so as to face away from the front surface.

11 Claims, 5 Drawing Sheets

(58) Field of Classification Search
USPC ..... 239/596–601, 556, 557
See application file for complete search history.

(56) References Cited

U.S. PATENT DOCUMENTS

| | | | | |
|---|---|---|---|---|
| 5,054,691 | A | 10/1991 | Huang et al. | 239/585.3 |
| 5,699,964 | A * | 12/1997 | Bergmann | B05B 1/185 239/106 |
| 5,718,387 | A | 2/1998 | Awarzamani et al. | 239/585.1 |
| 5,730,361 | A * | 3/1998 | Thonnes | B05B 15/528 239/106 |
| 5,752,316 | A * | 5/1998 | Takagi | B23P 15/16 29/888.4 |
| 6,267,305 | B1 * | 7/2001 | Kondo | B05B 1/1618 239/428.5 |
| 7,011,257 | B2 | 3/2006 | Heyse | 239/533.2 |
| 7,770,823 | B2 | 8/2010 | Kubota et al. | 239/533.14 |
| 2001/0022024 | A1 * | 9/2001 | Takeuchi | B05B 1/00 29/890.142 |
| 2003/0116650 | A1 | 6/2003 | Dantes et al. | 239/463 |
| 2004/0217213 | A1 * | 11/2004 | Nally | F02M 51/0653 239/585.1 |
| 2005/0242214 | A1 * | 11/2005 | Joseph | F02M 61/1853 239/596 |
| 2007/0095952 | A1 * | 5/2007 | Heinstein | F02M 51/0671 239/585.1 |
| 2009/0057444 | A1 * | 3/2009 | Heyse | F02M 61/1853 239/461 |
| 2009/0200402 | A1 * | 8/2009 | Gesk | F02M 61/1853 239/533.12 |
| 2011/0067717 | A1 * | 3/2011 | McHugh | A01K 13/001 132/114 |
| 2012/0193566 | A1 * | 8/2012 | Yasukawa | F02M 61/162 251/366 |
| 2012/0247427 | A1 * | 10/2012 | Saito | F02M 61/162 123/472 |
| 2015/0115068 | A1 | 4/2015 | Kochanowski et al. | 239/584 |

FOREIGN PATENT DOCUMENTS

| | | | | |
|---|---|---|---|---|
| DE | 19530995 | A1 | 2/1997 | F02M 61/16 |
| DE | 10124748 | A1 | 2/2003 | F02M 51/06 |
| DE | 102012209326 | A1 | 12/2013 | F02M 61/18 |
| EP | 0718490 | A2 | 6/1996 | F02M 51/06 |
| JP | 2008297966 | A | 12/2008 | F02M 51/06 |
| JP | 2010185324 | A | 8/2010 | F02M 51/06 |
| WO | 02/29244 | A1 | 4/2002 | F02M 51/06 |
| WO | 2015/086536 | A1 | 6/2015 | F02M 61/18 |

OTHER PUBLICATIONS

International Search Report and Written Opinion, Application No. PCT/EP2014/076912, 18 pages, dated Mar. 6, 2015.

Korean Office Action, Application No. 2017064561792, 15 pages, dated Sep. 14, 2017.

* cited by examiner

NOZZLE HEAD AND FLUID INJECTION VALVE

CROSS-REFERENCE TO RELATED APPLICATIONS

This application is a U.S. National Stage Application of International Application No. PCT/EP2014/076912 filed Dec. 8, 2014, which designates the United States of America, and claims priority to DE Application No. 10 2013 225 948.4 filed Dec. 13, 2013, the contents of which are hereby incorporated by reference in their entirety.

TECHNICAL FIELD

The present disclosure relates to internal combustion engines in general and, in some specific embodiments, nozzle heads and fluid injection valves for use with internal combustion engines.

BACKGROUND

Fuel injection valves may include a nozzle head for atomizing a fluid. Fuel injection valves of this type are customarily used for atomizing fuel in a combustion chamber of an internal combustion engine. In particular, if the fuel is "directly injected" into the combustion chamber of an internal combustion engine designed as a spark-ignition engine, the fuel may be very finely atomized, inter alia with the aid of the nozzle head. In order to produce as complete a combustion as possible in a spark-ignition engine, a fine mixture of air present in the combustion chamber and the injected fuel is required.

With the aid of the direct injection, the fuel in spark-ignition engines of internal combustion engines may be directly injected into the combustion chamber, thus affording the advantage of reduced fuel consumption in comparison to an earlier method of introducing fuel, the "manifold injection". Furthermore, control of an exhaust gas after treatment system of the internal combustion engine may be considerably improved with the aid of direct injection.

A further advantage of direct injection is an improvement in elasticity of the internal combustion engine in respect of the response behavior thereof during dynamic operation. The fuel enters the combustion chamber substantially more rapidly than in the case of the manifold injection, in which the fuel enters the combustion chamber together with the combustion air flowing in via a gas inlet valve. However, it is problematic that the required homogeneous mixture has to be prepared within a short period of time in order to obtain the direct injection advantages mentioned. Since the fuel is introduced rapidly in the combustion chamber, only little time is available for the fuel to evaporate and to mix with the combustion air.

The fuel injection valve and the spray preparation thereof are therefore particularly important in particular for the direct injection. The fuel should be introduced into the cylinder with the aid of particularly fine atomization. A droplet size of the fuel should be designed to be as small as possible so that rapid preparation can be achieved providing a homogeneous mixture within a very short period of time.

The fuel also should not pass onto cylinder walls of the combustion chamber since this creates the possibility of "oil dilution". Since the oil dilution causes a change in a lubricant composition, it can cause severe damage to the internal combustion engine because the diluted lubricating oil has an inadequate viscosity behavior. A piston head and/or gas inlet valves should not be wetted by the fuel since the fuel can only inadequately evaporate from there.

Deposition of the fuel on the fuel injection valve is a further problem. After a few operating hours of the internal combustion engine, the fuel injection valve has a firm and soot-like deposition layer. Fuel of subsequent injection cycles may accumulate in said deposition layer. In later combustion cycles, said fuel may escape in the form of fuel vapor and lead to undesirable, soot-developing combustion. This leads to a disadvantageously large and possibly impermissible number of soot particles in the exhaust gas of the internal combustion engine.

A reduction in soot particles is intended by providing nozzle holes into the nozzle head with the aid of a laser method. This may provide the advantage over a customary electrode method by providing sharp-edged nozzle holes. A further possibility for reducing the deposition layer is an increase in a fuel pressure upstream of the nozzle head so the fuel exits the nozzle head at a magnitude that deposits are avoided and therefore a deposition layer is not built up. However, this is highly costly since an increase in the fuel pressure can be realized only with a higher consumption of energy. Furthermore, all of the components exposed to the fuel pressure have to have a higher strength which is adapted to the higher fuel pressure and which can be realized firstly with more expensive materials and/or with an increase in a corresponding component wall.

SUMMARY

The teachings of the present disclosure provide a nozzle head for a deposition-reduced or deposition-free fuel injection valve.

In some embodiments, a nozzle head (11) for atomizing a fluid for a fluid injection valve with a valve body, through which flow can pass, has a longitudinal axis (14) and a nozzle perforated disk (10) which has a front surface (16) and an opposite inner surface (26). The nozzle perforated disk (10) has at least one nozzle hole channel (12; 13) which completely penetrates the nozzle perforated disk (10) in the direction of the longitudinal axis (14). The nozzle perforated channel (12; 13) has an entry surface (22) at its first channel end (18) and an outlet surface (24) at its second channel end (20), which is arranged facing away from the first channel end (18), wherein the entry surface (22) is formed on the inner surface (26). A nozzle hole projection (25) of the nozzle hole channel (12; 13) has a channel wall (40), wherein the channel wall (40) has a wall height (h) which extends away from the inner surface (26), starting from the front surface (16), in the direction of the longitudinal axis (14) and is configured over a circumference of the nozzle hole projection (25) in such a manner that the second channel end (20) corresponds to a channel wall end (46) of the channel wall (40), which channel wall end is configured so as to face away from the front surface (16).

In some embodiments, the channel wall (40) is of hollow frustoconical design.

In some embodiments, the outlet surface (24) is configured to be smaller than the entry surface (22).

In some embodiments, a further nozzle hole channel (13; 12) is configured so as to penetrate the nozzle perforated disk (10) in such a manner that, at an axial distance (W2) from the front surface (16), which axial distance is formed in the direction of the longitudinal axis (14), a free radial distance D is formed between the nozzle hole channel (12; 13) and the further nozzle hole channel (13; 12), wherein:

$$h \geq \tfrac{1}{4} \cdot D$$

and wherein the second axial distance (W2) corresponds to the wall height h.

In some embodiments, the wall height h is formed in accordance with h=2/8·D.

In some embodiments, the nozzle hole projection (25) has an outer circumferential surface (44), the contour (45) of which is formed in a longitudinal section in accordance with a continuously differentiable function.

In some embodiments, the outer circumferential surface (44) is of ramp shaped design.

In some embodiments, the nozzle hole channel (12; 13) has a first channel region which is adjacent to the entry surface (22) and the cross sectional area of which is smaller than the cross sectional area of a second channel region of the nozzle hole channel (12; 13), which channel region is adjacent to the outlet surface (24).

In some embodiments, the nozzle hole channel (12; 13) has a step between the first and the second channel region.

In some embodiments, a fluid injection valve includes a valve body, through which flow can pass. A supply device for supplying a fluid is formed at a first axial end of the valve body, and a nozzle head (11) as described above for atomizing the fluid is arranged at a second axial end of the valve body. The second axial end is formed facing away from the first end, wherein the front surface (16) is configured so as to face away from the first end and the inner surface (26) is configured so as to face the first end.

BRIEF DESCRIPTION OF THE DRAWINGS

Further advantages, features, and details of the nozzle head, the valve body and the fluid injection valve emerge from the description below of exemplary embodiments and with reference to the drawings. The features and combinations of features mentioned above in the description and the features and combinations of features which are mentioned below in the description of the figures and/or are shown solely in the figures can be used not only in the respectively stated combination, but also in different combinations or on their own without departing from the scope of the invention. Identical or functionally identical elements are assigned identical reference signs. For reasons of clarity, it is possible for the elements not to be provided with their reference signs in all of the figures, but without losing their assignment.

DETAILED DESCRIPTION

Figure 1:
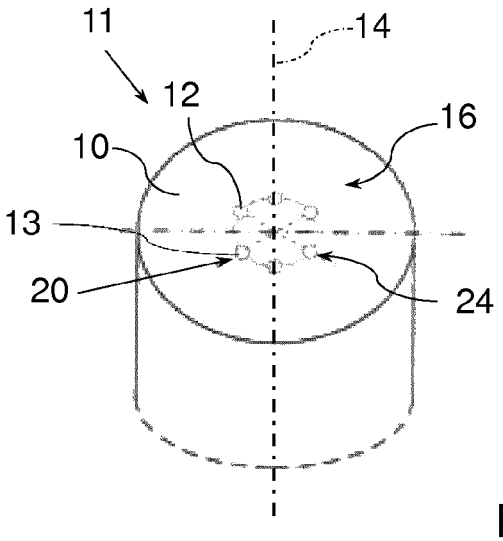
FIG. 1 shows schematically, in a perspective illustration, a nozzle perforated disk of a fuel injection valve according to the prior art.

In some embodiments, the nozzle head may be disposed in a fluid injection system to atomize the fluid. The fluid may comprise a fuel for an internal combustion engine, e.g., gasoline. The nozzle head has a longitudinal axis.

In some embodiments, a supply device for supplying the fluid is formed at a first end of the valve body. The nozzle head for atomizing the fluid is arranged at a second end of the valve body, which end is configured so as to face away from the first end. The nozzle head and the valve body may have a common longitudinal axis. The nozzle head can be formed integrally with a basic body of the valve body. Alternatively, the nozzle head may be a separate workpiece which is fixed on the basic body of the valve body.

Some embodiments include a fluid injection valve, in particular a fuel injection valve, with the nozzle head or with the valve body. The fuel injection valve may inject fuel directly into a combustion chamber of the internal combustion engine.

The nozzle head may have a nozzle perforated disk. The nozzle perforated disk has a front surface and an inner surface opposite the front surface. In some embodiments, the front surface is configured so as to face away from the first end of the valve body, and the inner surface is configured so as to face the first end of the valve body. In some embodiments, a first axial distance is formed between the inner surface and the front surface, which distance extends in the direction of the longitudinal axis.

In some embodiments, the nozzle perforated disk has at least one nozzle hole channel which completely penetrates the nozzle perforated disk in the direction of the longitudinal axis. An entry surface is formed at the first channel end assigned to the nozzle hole channel, and an outlet surface is formed at a second channel end of the nozzle hole channel, which channel end is arranged facing away from the first channel end. The entry surface is arranged on the inner surface of the nozzle perforated disk. A nozzle hole projection of the nozzle hole channel, which nozzle hole projection is positioned in particular at the first axial distance from the entry surface, has a channel wall. The channel wall is formed over a circumference of the nozzle hole projection. In other words, the channel wall of the nozzle hole projection defines a portion of the nozzle hole channel. The channel wall runs here in particular completely about a channel axis of the nozzle hole channel. The channel wall has a wall height which extends in particular away from the inner surface, starting from the front surface, in the direction of the longitudinal axis in such a manner that the second channel end corresponds to a channel wall end of the channel wall, which channel wall end is configured so as to face away from the front surface.

With the aid of the channel wall of the nozzle hole projection, the nozzle hole channel is therefore extended in its axial extent formed along the longitudinal axis. If the second channel end and therefore the outlet surface were contained, according to the prior art, in a smooth front surface, for example at a first axial distance from the entry surface in the direction of the longitudinal axis, the second channel end is now positioned with the aid of the nozzle hole projection at a distance, which is increased by the wall height, from the entry surface. In one refinement, the distance of the outlet surface corresponds to a sum of the first axial distance and of the wall height. This has the consequence that the outlet surface of the nozzle hole channel, which outlet surface is formed at the second channel end, is formed on the nozzle perforated disk at a distance from the front surface. The second channel end is in particular offset in relation to the front surface in a direction away from the inner surface.

If the outlet surface is not present spaced apart axially from the front surface in the direction of the longitudinal axis, in the region of the front surface ambient air which is present there is sucked up over a circumference of the outlet surface. That is to say, the ambient air present in the region of the fuel spray is entrained by the fuel spray. This effect, the carrying along or entraining of the air in the region of a fluid spray, is known and is used in particular in water jet pumps in order to produce large volumetric flows.

With the aid of the channel wall which spaces the outlet surface apart axially from the front surface in the direction of the longitudinal axis, the possibility is realized of supplying ambient air to the fuel emerging from the nozzle hole channel and/or from the outlet surface. This means that a larger volumetric flow can be achieved which realizes improved, that is to say more rapid, fuel preparation. Since the ambient air present over the circumference of the outlet surface is entrained by the fuel of the fuel spray, a region pressure is formed in this region, the region pressure preventing or at least greatly reducing a backflow of fuel vapor and/or fuel droplets. That is to say, the risk of the formation of depositions is particularly low. In this manner, a deposition-reduced or deposition-free fuel injection nozzle is realized.

In some embodiments, a valve needle is arranged in the valve body. The valve needle is axially movable in relation to the valve body in such a manner that, in a closed position of the valve needle, a closing element of the valve needle bears against a valve seat of the valve body in order to prevent fluid flow through the nozzle hole channels, and the valve needle can be displaced away from the closed position by means of an actuator unit of the fluid injection valve in order to release fluid flow through the nozzle hole channels.

In some embodiments, the inner surface of the nozzle perforated disk includes the valve seat. The nozzle head can thereby be used for comparatively large fluid pressures, for example of 100 bar or more, preferably of 200 bar or more, in particular within a range of between 250 bar and 500 bar, with the limits being included.

In some embodiments, the channel wall is of hollow-frustoconical design. The advantage of this refinement is that the ambient air present in the region of the channel wall has an incident flow direction which is inclined with respect to the fuel spray which emerges from the outlet surface. The ambient air can therefore be better supplied to the fuel spray. That is to say, the flow direction of the ambient air guided via the hollow-frustoconical channel wall crosses the flow direction of the fuel spray, and therefore thorough mixing of the fuel spray and of the ambient air is already brought about by the flow directions. The improved supply capability can be seen in comparison to a channel wall formed in the manner of a hollow cylinder. In the case of a channel wall formed in the manner of a hollow cylinder, the ambient air has the same flow direction as the fuel spray, and therefore, because of the identical flow directions, the supply capability and therefore thorough mixing take place only with the aid of the entraining of the ambient air.

In some embodiments, the outlet surface is configured to be smaller than the entry surface. This has the advantage that the fuel which flows through the nozzle hole channel has, in accordance with Bernoulli's law of fluid dynamics, a first speed at the outlet surface, which speed is greater than a second speed which prevails in the entry surface or in the region of the entry surface. The fuel atomization is therefore improved in a simple manner because of an increase in speed at the outlet surface.

In some embodiments, the nozzle perforated disk has a plurality of nozzle hole channels, that is to say, at least one further nozzle hole channel is configured so as to penetrate the nozzle perforated disk. The nozzle hole channels may be arranged at a certain, generally uniform, radius from a center of a nozzle perforated disk, in particular along the longitudinal axis, in top view, wherein, in some embodiments, the center of the nozzle perforated disk lies on the longitudinal axis. As soon as the fuel is injected, a fuel spray which is configured in the form of a cone is produced per nozzle hole channel. In the region of the center of the nozzle perforated disk, an inner region which is bordered by the fuel sprays is thereby formed. A lower pressure prevails in said inner region than in an ambient region delimited by the fuel sprays. In the ambient region, a first region pressure is present in the vicinity of the fuel spray, said region pressure being lower than a second region pressure in an ambient region further away from the fuel spray. A third region pressure formed in the inner region is significantly reduced in relation to the first region pressure and the second region pressure.

There is the risk that the third region pressure is so low in comparison to a first region pressure in the ambient region that a negative pressure is formed in the inner region, which leads to a reversal of the direction of the fuel vapor and/or of fuel droplets. That is to say, in this case, the fuel vapor and/or the fuel droplets flow back onto the front surface in order to be deposited there in the form of depositions. So that an effective axial distance of the outlet surface from the front surface is formed, the wall height can be determined depending on a free radial distance. Said free radial distance is a distance formed radially between the nozzle hole channel and the further nozzle hole channel. A particularly advantageous wall height can be described, depending on the radial distance, as follows:

$$h \geq \tfrac{1}{4} \cdot D$$

wherein h corresponds to the wall height and D corresponds to the free radial distance.

With such a wall height which is determined depending on the free radial distance between the nozzle hole channels, a flow channel of adequate size is formed, via which ambient air can be conducted into the inner region, and therefore the third region pressure in the inner region is of a size such that a backflow of fuel vapor and/or fuel droplets is particularly readily prevented in the inner region.

The wall height is expediently formed in accordance with $h = \tfrac{2}{8} \cdot D$.

A channel wall thickness of the channel wall which bounds the flow channel is taken into consideration here.

In some embodiments, the nozzle hole projection can have an outer circumferential surface, the contour of which is formed in a longitudinal section in accordance with a continuously differentiable function. The advantage is therefore created that tearing off of flow filaments of the ambient air flowing over the channel wall and entrained by the fuel spray is avoided. The outer circumferential surface is preferably of ramp-shaped design. Expressed in other words, the nozzle hole projection preferably has, at least in its region adjacent to the front surface, an outer contour which, in longitudinal section, has the form of a continuously differentiable function and/or is of ramp-shaped design, i.e. in particular in the form of a ramp function.

In some embodiments, the nozzle hole channel has a first channel region which is adjacent to the entry surface and the cross-sectional area of which is smaller than the cross-sectional area of a second channel region of the nozzle hole channel, which channel region is adjacent to the outlet surface. In a development, the nozzle hole channel has a step between the first and the second channel region.

The nozzle perforated disk of a fuel valve of the prior art is shown in FIG. 1. In this case, the fuel injection valve is a "multistream injector", i.e., the nozzle perforated disk 10 has a plurality of nozzle hole channels 12, wherein the nozzle hole channel 12 completely penetrates the nozzle perforated disk 10.

The fuel injection valve comprises a valve body (not illustrated specifically) with a longitudinal axis 14, wherein a supply device (not illustrated specifically) for supplying a fluid, generally fuel for internal combustion engines, is formed at a first end of the valve body.

The nozzle head 11 with the nozzle perforated disk 10 for atomizing the fluid is arranged at a second end of the valve body, which end is configured so as to face away from the first end. The nozzle perforated disk 10 has a front surface 16 which is configured so as to face away from the first end.

The nozzle hole channel 12 has an entry surface 22 at a first channel end 18 (see FIGS. 9 and 10) and an outlet surface 24 at a second channel end 20, which is arranged facing away from the first channel end 18, wherein the entry surface 22 is formed on an inner surface 26 of the nozzle perforated disk 10, which inner surface is configured so as to face away from the front surface 16. There is a first axial distance W1 extending in the direction of the longitudinal axis 14 between the inner surface 26 and the front surface 16.

The nozzle perforated disk 10 is accommodated in the nozzle head 11 of the fuel injection valve. The nozzle head 11 is positioned at the second end of the fuel injection valve, which end is arranged in a combustion chamber (not illustrated specifically) of an internal combustion engine (not illustrated specifically). This means that fuel which is supplied to the internal combustion engine with the aid of the fuel injection nozzle is injected directly into the combustion chamber. In particular, it is important for optimum operation, i.e. efficient and low-emission operation, of the internal combustion engine that the fuel is supplied to the combustion chamber in a finely atomized form—i.e. in very fine droplets—with the aid of the fuel injection nozzle. This fine atomization leads to rapid fuel preparation, i.e. to a formation of a mixture between the fuel injected into the combustion chamber and combustion air which is already present in the combustion chamber and is generally partially compressed.

In particular, the fuel preparation in an internal combustion engine configured as a spark-ignition engine or gasoline engine places great demands on the fine atomization. This is because this type of internal combustion engine functions on the basis of "spark ignition", i.e., a fuel-air mixture present in the combustion chamber with the aid of the formation of the mixture is ignited with the aid of a spark plug. This form of ignition requires a homogeneous fuel-air mixture so that complete combustion of the fuel-air mixture can be brought about. Since this is required within a very short time within an injection cycle, there is the need for fine atomization with the aid of the fuel injection valve.

There is a similarly high requirement for fine atomization of the fuel also in the case of an internal combustion engine configured as a diesel engine. The air-fuel mixture present in the combustion chamber of an internal combustion engine configured as a diesel engine is burned on the basis of "self-ignition". That is to say, the ignition takes place here because of high temperatures in the combustion chamber that can be achieved by a high compression pressure. The air-fuel mixture is ignited at different points, the "ignition ovens", in the combustion chamber, and the combustion continues on the basis of a rising temperature and rising pressure in the air-fuel mixture. Inadequate combustion leads here to a "formation of soot" which can be avoided with the aid of fine atomization. The fine atomization can be achieved with a plurality of nozzle hole channels 12 formed on the nozzle perforated disk 10. In principle, a fineness of the atomization is dependent on the diameter of the nozzle hole channel 12 and on the fuel pressure. The smaller the diameter of the nozzle hole channel 12 or the diameter of the outlet surface 24 and the higher the pressure, the finer is the atomization. It should be taken into consideration that a fuel mass to be injected is, however, also dependent on the diameter of the nozzle hole channel 12. That is to say, in turn, the smaller the outlet surface 24, the smaller is the fuel mass per outlet surface 24. A number of the nozzle hole channels 12 should therefore be taken into consideration in order to achieve the desired fuel mass to be injected. It should not remain unmentioned at this juncture that an "injection pressure" is similarly crucial for fine atomization.

So that atomization can be realized, the nozzle hole channels 12 are introduced into the nozzle perforated disk 10 in a manner completely penetrating the nozzle perforated disk 10. During an injection operation, the entry surfaces 22 of the nozzle hole channels 12 are exposed with the aid of a nozzle needle (not illustrated specifically), and therefore the fuel located in a valve body of the fuel injection valve flows via the outlet surfaces 24 to the valve body under a corresponding injection pressure.

Figure 2:
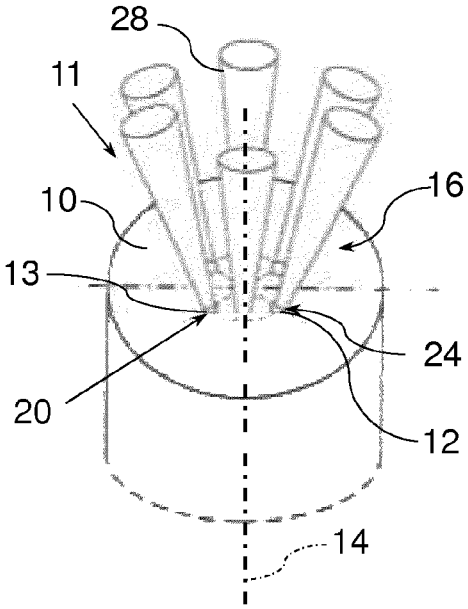
FIG. 2 shows schematically, in a perspective illustration, the nozzle perforated disk according to FIG. 1 with fuel sprays during an injection operation.

FIG. 2 shows schematically fuel flowing out of the outlet surfaces 24 in the form of fuel sprays 28 during an injection operation. According to the laws of fluid mechanics, the fuel flows out of a nozzle hole channel 12, forming a fuel cone.

Figure 3:
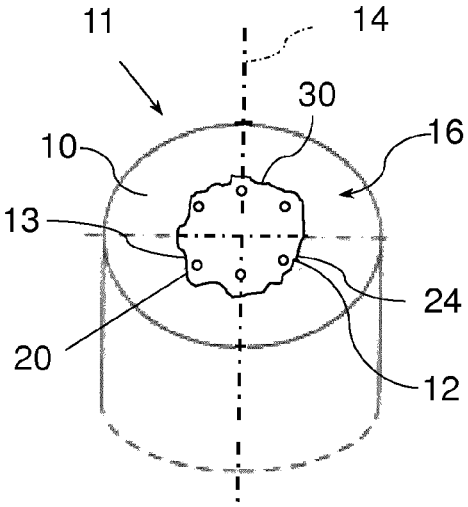
FIG. 3 shows schematically, in a perspective illustration, the nozzle perforated disk with a deposition layer.
Figure 4:
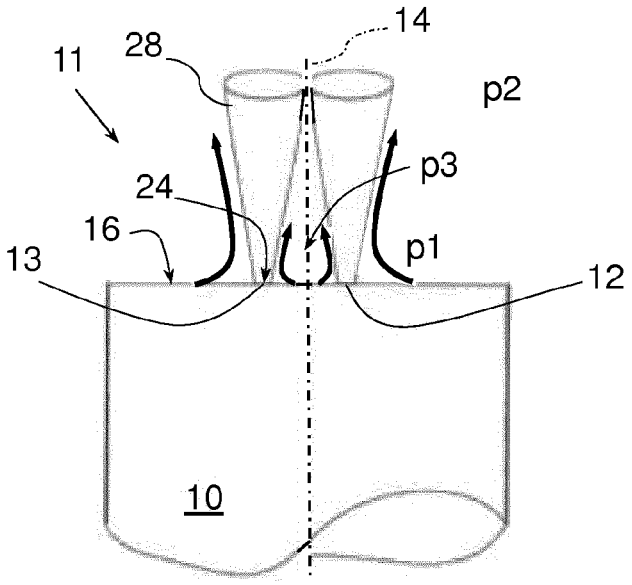
FIG. 4 shows, in a side view, the nozzle perforated disk according to FIG. 1, with a fuel spray spread of two nozzle holes arranged next to each other, and region pressures arising in the region of the fuel sprays without backflow.

It is problematic that, after a plurality of operating cycles of the internal combustion engine, i.e., after a plurality of ignitions and corresponding combustions, a firm and soot-like deposition 30 may form in the region of the outlet cross-sectional areas 24, as illustrated by way of example in FIG. 3. This deposition 30 is a result of a pressure ratio prevailing in the region of the fuel spray 28 during an injection operation. For explanation purposes, a side view of the nozzle perforated disk 10 according to the prior art is illustrated in FIG. 4. In an environment of two fuel sprays each emerging from a nozzle opening, different pressures arise in different regions of the fuel sprays, said pressures being referred to below as region pressures.

Ambient air is sucked up in an outlet region of the fuel by the fuel flowing out of the outlet surfaces 24. In other words, the ambient air located in the region of the fuel spray 28 is entrained by the fuel spray 28.

Figure 5:
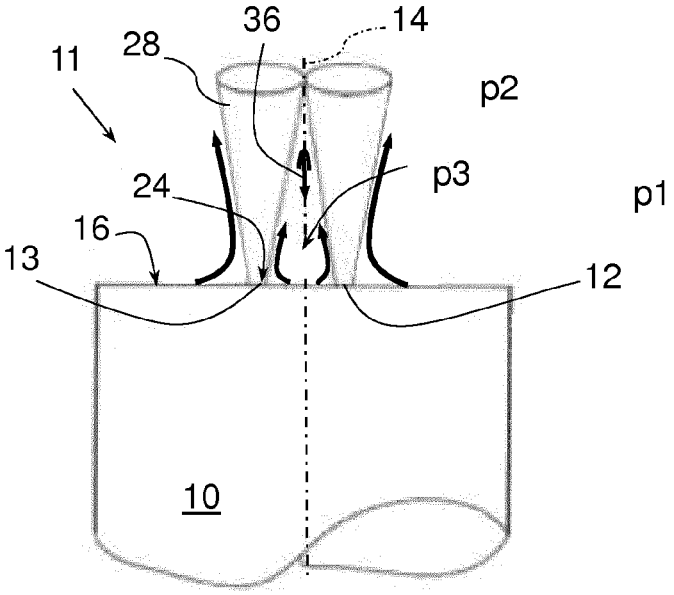
FIG. 5 shows, in a side view, the nozzle perforated disk according to FIG. 1, with a fuel spray spread of two nozzle holes arranged next to each other, and region pressures arising in the region of the fuel sprays with backflow of fuel vapors.

This means that, in a suction region which is located on the front surface 16 in the region of the outlet surface 24, a lower first region pressure p1 arises than in an ambient region which is remote from the outlet surface 24 and in which a second region pressure p2 prevails, see FIGS. 4 and 5. In particular, a third region pressure p3 is formed in an inner region 32 formed between the fuel sprays 28, said third region pressure being greatly reduced in comparison to the first region pressure p1 and the second region pressure p2, and constituting an extreme negative pressure. This third region pressure p3 which is greatly reduced in comparison to the other region pressures arises in the inner region 32 since only little ambient air or combustion air, if any at all, can flow back here.

As a consequence of said third region pressure p3, turbulences may be caused between outflowing ambient air and backflowing fuel vapors. A backflow direction is indicated with the aid of the backflow arrow 36 in the inner region 32 between the fuel sprays 28 of FIG. 5. The fuel vapors are already formed during the injection operation because of high combustion chamber temperatures. In other words, the fuel is present in a liquid state of aggregation and a vaporous state of aggregation during the injection operation.

This means, in other words, that fuel emerging from the outlet surface 24 is remote from the front surface 16 customarily and predominantly in the direction of the direction arrow y. However, because of the negative pressure p3 which forms in the inner region 32 between the fuel sprays 28, a backflow of a fuel vapor and fuel droplet mixture occurs. Said mixture accumulates on the front surface 16.

Figure 6:
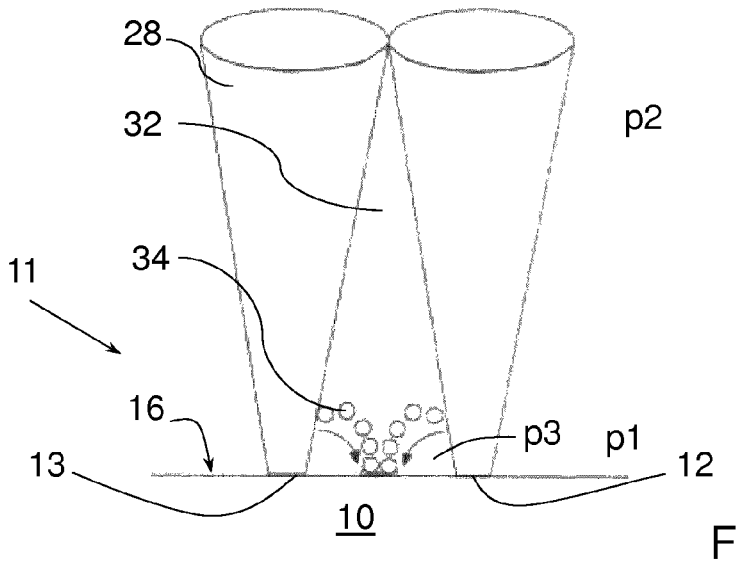
FIG. 6 shows, in a detail, an enlarged illustration of the nozzle perforated disk according to FIG. 5, with back flowing fuel droplets.

The fuel vapors flowing back because of the turbulence can be thoroughly mixed with fuel droplets 34, see FIG. 6. Said fuel droplets 34 are then accelerated in the direction of the front surface 16 of the nozzle perforated disk 10 and are deposited on the front surface 16 in the region of the outlet surfaces 24. In other words, the fuel particles located in the inner region 32 at least partially have a reversal of the flow direction. Said reversal of the flow direction is reduced with an increase in an outlet speed of the fuel from the outlet surfaces 24, which increase can be realized with the aid of an increase in the injection pressure since, as the outlet speed increases, the third region pressure p3 is no longer of a size sufficient to accelerate the fuel droplets in the direction of the front surface 16.

Figure 7:
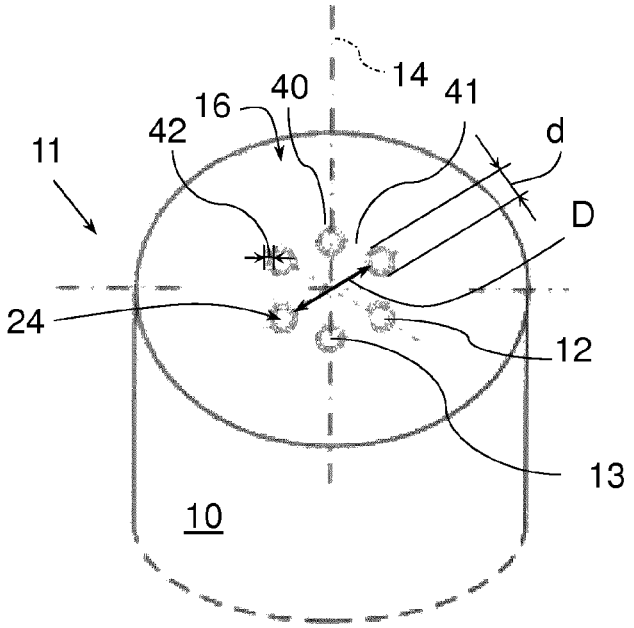
FIG. 7 shows schematically, in a perspective illustration, an example nozzle head of a fuel injection valve according to the invention.

In contrast, a nozzle perforated disk 10 of the fuel injection valve according to the teachings of the present disclosure is shown in FIG. 7. The nozzle hole channel 12 has a nozzle hole projection 25 with a channel wall 40, with the aid of which the outlet surface 24 is present spaced from the front surface 16 in the direction away from the inner surface 26.

The nozzle hole projection 25 is positioned here at a first axial distance W1 from the entry surface 22. In the region of the nozzle hole projection 25, the channel wall 40 is formed over a circumference of the nozzle hole channel 12, said channel wall 40 having a wall height h extending, starting from the front surface 16, in the direction of the longitudinal axis 14.

The second channel end 20 therefore corresponds to a channel wall end 46 of the channel wall 40, which channel wall end is configured so as to face away from the front surface 16.

That is to say, in another words, the channel wall 40 of the nozzle hole 25 extends here from a plane common with the front surface 16, in a manner surrounding the nozzle hole channel 12, such that the axial extent of said channel wall is formed, starting from the front surface 16, in the direction of the fuel spray 28.

In some embodiments, the fuel injection valve has a channel wall 40 which is of hollow-frustoconical design. The channel wall 40 of hollow-frustoconical design has an inner circumferential surface which tapers conically and, in the region of the nozzle hole projection 25, completely laterally encircles the nozzle hole channel 12 such that the outlet surface 24 is configured to be smaller than a channel cross-sectional area of the nozzle hole 25, which channel cross-sectional area is positioned upstream from the outlet surface 24 at the distance h and has the diameter d, which is shown in the figures.

In some embodiments, the inner circumferential surface has the form of a cylinder lateral surface, in particular a circular-cylinder lateral surface. In some embodiments (not illustrated specifically), the channel wall 40 is of hollow-cylindrical design.

The wall height h is determined in such a manner that the inner region 32 can be supplied with ambient air in the quantity as is entrained during a flow of the fuel out of the outlet surface 24 in accordance with the principle of the water jet pump.

A free radial distance D is formed between two oppositely arranged nozzle hole channels 12, 13, e.g., between a nozzle hole channel 12 and a further nozzle hole channel 13. The free radial distance D is understood as meaning the distance between the nozzle hole channel 12 and the further nozzle hole channel 13, which distance is formed between two channel walls 40 arranged next to each other. The free radial distance D is the distance between the nozzle hole channel 12 and the further nozzle hole channel 13, which distance is determined at an axial distance from the front surface 16 along the longitudinal axis 14 and corresponds to the wall height h.

It should be noted here that the free radial distance D should be determined here along a diameter of the nozzle perforated disk 10. This can be assumed since the nozzle perforated disk 10 customarily has a circumference of circular design. If, however, the nozzle perforated disk 10 does not have a circular circumference and/or an arrangement of the nozzle hole channels is not positioned symmetrically about a center point of the nozzle perforated disk 10, the free radial distance D should be determined between two opposite nozzle hole channels 12.

The wall height h can be determined depending on the radial distance D by:

$$h \geq \tfrac{1}{4} \cdot D.$$

As illustrated in FIG. 7, an aisle-like flow channel 41 is therefore formed between in each case two adjacent nozzle hole channels 12. So that said flow channel 41 is configured for a sufficient supply of air into the inner region 32, a channel wall thickness 42 of the channel wall 40 should additionally be taken into consideration in the determination of the wall height h. This means that the wall height h should be selected to be greater than a quarter of the radial distance D. If, for example, the radial distance D between the nozzle hole channels 12 is 6 mm, a wall height h of 1.5 mm is produced. So that a sufficiently large flow channel 41 can now be created, the wall height h should be determined to be approx. 2 mm.

Figure 8:
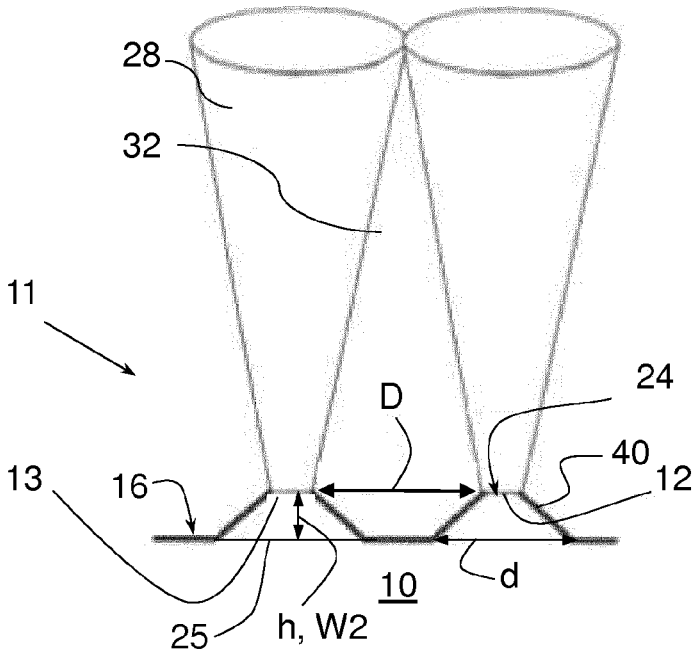
FIG. 8 shows, in a detail, a side view of an example nozzle perforated disk of the fuel injection valve according to the teachings of the present disclosure, with a fuel spray spread, and region pressures arising in the region of the fuel sprays.
Figure 9:
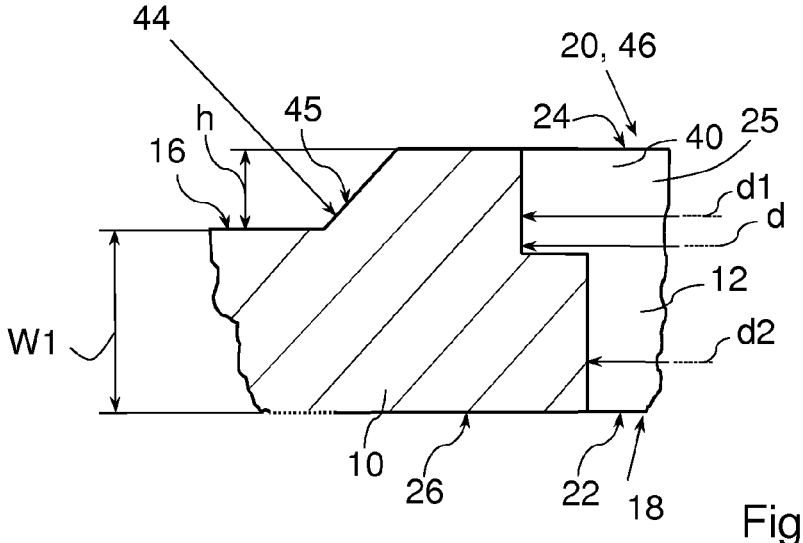
FIG. 9 shows, in a detail, an example nozzle perforated disk of the fuel injection valve according to the teachings of the present disclosure.
Figure 10:
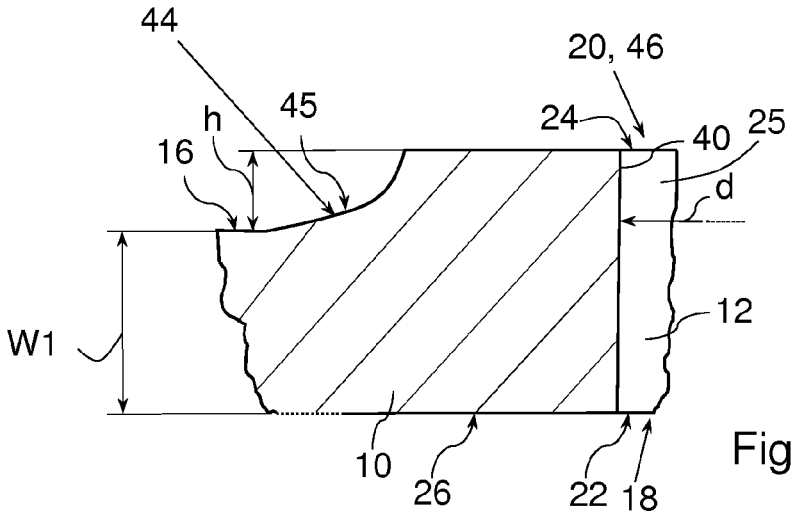
FIG. 10 shows, in a detail, an example nozzle perforated disk of the fuel injection valve according to the teachings of the present disclosure.

As illustrated in FIGS. 8 to 10, the nozzle hole projection 25 has an outer circumferential surface 44. In the exemplary embodiment of FIG. 9, said outer circumferential surface 44 has a contour 45 which is ramp-shaped in a longitudinal section. According to FIG. 10, said contour 45 is formed rounded in the manner of a ramp, i.e. in the form of a curved, continuously differentiable function.

As shown in FIG. 9, in some embodiments, the nozzle hole channel 12 is configured in the form of a stepped hole such that the nozzle hole channel 12 has different channel diameters. The channel diameter d1 in a first channel region, which is configured so as to face the entry surface 22, is smaller than a second channel diameter d2 of a second channel region of the nozzle hole channel 12, which channel region is configured so as to face the outlet surface 24, and therefore the first channel region has a smaller cross-sectional area than the second channel region. The nozzle hole channel 12 has a step between the first and the second channel region. In the present case, the second channel region extends in the axial direction from the nozzle hole projection 25 beyond the front surface 16 in the direction of the inner surface 26.

What is claimed is:

1. A nozzle head for atomizing a fluid for a fluid injection valve with a valve body, through which flow can pass, the nozzle head comprising:

a longitudinal axis; and a nozzle perforated disk having a front surface and an opposite inner surface and a nominal thickness (W1), the inner surface defining a valve seat providing a stop for a needle of the fluid injection valve, wherein the needle obstructs flow of the fluid through the valve body in a closed position bearing against the valve seat;

wherein the nozzle perforated disk comprises two or more nozzle hole channels completely penetrating the nozzle perforated disk, wherein each nozzle hole channel includes a channel entry at a first channel end and a channel outlet at a second channel end facing away from the first channel end, wherein the channel entry is formed on the inner surface of the nozzle perforated disk, a nozzle hole projection of each nozzle hole channel includes a channel wall having a wall height (h) extending beyond the nominal thickness (W1) of the nozzle perforated disk, starting from the front surface, in a direction along the longitudinal axis and is configured over a circumference of said each nozzle hole channel so that the second channel end corresponds to a channel wall end of the channel wall configured so as to face away from the front surface, wherein each nozzle hole projection has a hollow frustoconical shape defining a tapered outer circumferential surface and a tapered inner surface, both extending along the full wall height (h) of the nozzle hole projection, and both narrowing along a direction away from the front surface of the nozzle perforated disk, at an axial distance (W2) from the front surface along the longitudinal axis, a free radial distance D is formed between adjacent nozzle hole channels of the two or more nozzle hole channels, wherein:

$h \geq \frac{1}{4} \cdot D$; and the axial distance (W2) corresponds to the wall height (h); and wherein the channel outlets at the second channel end of each nozzle hole channel define a total outlet area from the nozzle perforated disk suitable for atomizing the fluid passing through the valve body.

2. The nozzle head as recited in claim 1, wherein the channel outlet is smaller than the channel entry.

3. The nozzle head as recited in claim 1, wherein the wall height $h = \frac{1}{4} \cdot D$.

4. The nozzle head as recited in claim 1, wherein the circumferential surface of each nozzle hole projection has a contour formed in a longitudinal section in accordance with a continuously differentiable function.

5. The nozzle head as recited in claim 4, wherein each said outer circumferential surface is ramp shaped.

6. A fuel injection valve configured to inject a fuel into a combustion chamber of an internal combustion engine, the fuel injection valve comprising:

a valve body having a fuel inlet and a fuel outlet;

a needle movable within the valve body;

a nozzle head for atomizing the fuel into the combustion chamber of the internal combustion engine, the nozzle head arranged at the fuel outlet and having a front surface facing away from the fuel inlet and an inner surface facing the fuel inlet, the nozzle head comprising:

a longitudinal axis; and a nozzle perforated disk having a front surface and an opposite inner surface and a nominal thickness (W1), the inner surface defining a valve seat providing a stop for the needle, wherein the needle obstructs flow of the fluid through the valve body in a closed position bearing against the valve seat;

wherein the nozzle perforated disk comprises two or more nozzle hole channels completely penetrating the nozzle perforated disk, wherein each nozzle hole channel includes a channel entry at a first channel end and a channel outlet at a second channel end facing away from the first channel end, wherein the channel entry is formed on the inner surface of the nozzle perforated disk, a nozzle hole projection of each nozzle hole channel includes a channel wall having a wall height (h) extending beyond the nominal thickness (W1) of the nozzle perforated disk, starting from the front surface, in a direction along the longitudinal axis and is configured over a circumference of said each nozzle hole channel so that the second channel end corresponds to a channel wall end of the channel wall configured so as to face away from the front surface, wherein the nozzle hole projection has a hollow frustoconical shape defining a tapered circumferential outer surface and a tapered inner surface, both extending along the full wall height h of the nozzle hole projection, and both narrowing along a direction away from the front surface of the nozzle perforated disk, at an axial distance (W2) from the front surface along the longitudinal axis, a free radial distance D is formed between adjacent nozzle hole channels of the two or more nozzle hole channels, wherein:

$h \geq \frac{1}{4} \cdot D$; and the axial distance (W2) corresponds to the wall height (h).

7. The fuel injection valve as recited in claim 6, wherein the channel outlet is smaller than the channel entry.

8. The fuel injection valve as recited in claim 6, wherein the wall height $h = \frac{1}{4} \cdot D$.

9. The fuel injection valve as recited in claim 6, wherein the circumferential surface of each of said nozzle hole projections has a contour formed in a longitudinal section in accordance with a continuously differentiable function.

10. The fuel injection valve as recited in claim 9, wherein the respective circumferential surface of each of said nozzle hole projections is ramp shaped.

11. A fuel injection valve configured to inject a fuel into a combustion chamber of an internal combustion engine, the fuel injection valve comprising:

a valve body through which the fuel can pass;

a needle movable within the valve body;

a nozzle head for atomizing the fuel into the combustion chamber of the internal combustion engine, the nozzle head arranged at an outlet end of the valve body opposite a fuel supply end and downstream from the valve seat and the needle, the nozzle head comprising: a longitudinal axis; and a nozzle perforated disk having a front surface and an opposite inner surface and a nominal thickness (W1), the inner surface defining a valve seat providing a stop for a needle of the fluid injection valve, wherein the needle obstructs flow of the fluid through the valve body in a closed position bearing against the valve seat;

wherein the nozzle perforated disk comprises two or more nozzle hole channels completely penetrating the nozzle perforated disk, wherein each nozzle hole channel includes a channel entry at a first channel end and a channel outlet at a second channel end facing away from the first channel end, wherein the channel entry is formed on the inner surface of the nozzle perforated disk, a nozzle hole projection of each nozzle hole channel includes a channel wall having a wall height (h) extending beyond the nominal thickness (W1) of the nozzle perforated disk, starting from the front surface, in a direction along the longitudinal axis and is configured over a circumference of said each nozzle hole channel so that the second channel end corresponds to a channel wall end of the channel wall configured so as to face away from the front surface, wherein the nozzle hole projection has a hollow frusto-conical shape defining a tapered circumferential outer surface and a tapered inner surface, both extending along the full wall height (h) of the nozzle hole projection, and both narrowing along a direction away from the front surface of the nozzle perforated disk, at an axial distance (W2) from the front surface along the longitudinal axis, a free radial distance D is formed between adjacent nozzle hole channels of the two or more nozzle hole channels, wherein:

$h \geq 1/4 \cdot D$; and the axial distance (W2) corresponds to the wall height (h); and wherein the channel outlets at the second channel end of each nozzle hole channel define a total outlet area from the nozzle perforated disk suitable for atomizing the fluid passing through the valve body.

* * * * *